US006708008B2

(12) United States Patent
Hayashida et al.

(10) Patent No.: US 6,708,008 B2
(45) Date of Patent: Mar. 16, 2004

(54) IMAGE FORMING APPARATUS AND IMAGE FORMING METHOD WITH TRANSFER BELT DRIVE UNIT CONTROL

(75) Inventors: Masatoshi Hayashida, Kawasaki (JP); Yuichi Yokoyama, Yokohama (JP); Sunao Takenaka, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/197,887

(22) Filed: Jul. 19, 2002

(65) Prior Publication Data

US 2004/0013440 A1 Jan. 22, 2004

(51) Int. Cl.[7] ..... G03G 15/16
(52) U.S. Cl. ..... 399/66; 399/43
(58) Field of Search ..... 399/66, 43, 24, 399/162

(56) References Cited

U.S. PATENT DOCUMENTS 6,038,423 A * 3/2000 Tagawa et al. ..... 399/162
6,219,496 B1 * 4/2001 Kojima et al. ..... 399/43
6,493,533 B1 * 12/2002 Munakata ..... 399/66

FOREIGN PATENT DOCUMENTS

JP 11109827 A * 4/1999 ..... G03G/21/14
JP 11-174932 7/1999
JP 2000199988 A * 7/2000 ..... G03G/15/01

* cited by examiner

*Primary Examiner*—Arthur T. Grimley
*Assistant Examiner*—Ryan Gleitz
(74) *Attorney, Agent, or Firm*—Foley & Lardner

(57) ABSTRACT

A microcomputer processes count data counted by a CPU counter, and accumulates it in a RAM. The microcomputer always accesses the count data accumulated in the RAM and compares it with preset count data. Based on the comparison result, the microcomputer controls the rotation speed of a drive motor for a transfer belt.

4 Claims, 6 Drawing Sheets

| | SPEED CONTROL | ① | | ② | |
|---|---|---|---|---|---|
| BELT LIFE COUNT | (COEFFICIENT) | PRESENCE OF CONTROL | DRIVING ROLLER SPEED | ABSENCE OF CONTROL | DRIVING ROLLER SPEED |
| | INCREMENT VALUE | BELT SPEED mm/sec ESTIMATION <mm/sec> | | BELT SPEED mm/sec ACTUAL MEASUREMENT <mm/sec> | |
| ~50000 | 0 | 421.7 | 421.7 | 421.7 | 421.7 |
| ~100000 | 1 | 421.8 | 422.2 | — | |
| ~150000 | 2 | 421.8 | 422.7 | — | |
| ~200000 | 3 | 421.8 | 423.2 | — | |
| ~250000 | 4 | 421.8 | 423.7 | — | |
| ~300000 | 5 | 421.8 | 424.2 | 420.2 | 421.7 |
| ~350000 | 6 | 421.8 | 424.7 | — | |
| ~400000 | 7 | 421.8 | 425.2 | — | |
| ~500000 | 8 | 421.5 | 425.7 | 419.1 | 421.7 |

IMAGE FORMING APPARATUS AND IMAGE FORMING METHOD WITH TRANSFER BELT DRIVE UNIT CONTROL

BACKGROUND OF THE INVENTION

The present invention relates to an image forming apparatus such as an electronic copying machine that forms an image using a belt transfer device, and an image forming method.

Recently, an increasing number of belt transfer devices have been used as means for transferring toner images formed on photosensitive drums. When a belt transfer device is used for transferring a toner image onto a transfer medium, the belt transfer apparatus can perform stable separation of the transfer medium from the photosensitive drum and can a have good transfer performance, irrespective of the kind or state of the transfer medium. Moreover, a plurality of times of transfer can easily be performed.

In addition, when a belt transfer device is used as an intermediate transfer device for effecting re-transfer on a transfer medium after completion of toner image transfer on a transfer belt, the degree of freedom in construction is enhanced both for primary transfer on the transfer belt and secondary transfer for the transfer medium. Thus, more various apparatus designs can be made.

However, in particular, in a case where an elastic belt is applied to a transfer member, the peripheral length, thickness and tension of the belt in the initial state will vary with the passing of time. Specifically, the various dimensions and physical properties of the transfer belt, whose design life is about to expire after printing and paper feeding, have varied and in general the speed of movement of the belt has lowered.

On the other hand, a photosensitive drum, which rotates in contact with the transfer belt, rotates at a substantially constant speed from the initial state to the end of the design life. As a result, a difference in speed of movement occurs between the photosensitive drum and the transfer belt. This may lead to defects in images, such as image magnification variation or blurring of images.

Consequently, as the transfer belt approaches the end of the design life, the level of image defectiveness rises. As means for solving these problems, there is a method in which the peripheral speed of the transfer belt is controlled by sensing it by means of a plurality of sensors provided at the position of the transfer belt. Based on differences in sensed times of the sensors, the peripheral speed of the belt is found. There is also a method wherein a rotary-type distance meter is put in contact with the peripheral surface of the belt, and the driving speed is directly read. However, these methods are disadvantageous with respect to an increase in cost, complex construction, lack in quickness, and low precision, and therefore these methods are not easily feasible.

BRIEF SUMMARY OF THE INVENTION

The object of the present invention is to provide an image forming apparatus and an image forming method capable of suppressing, with low cost, defects in images, such as blurring of images or image magnification variation, due to lowering in speed of a transfer belt, without the need to provide sensors for sensing and controlling the variation in speed of the transfer belt.

In order to achieve the object, there is an image forming apparatus which has a belt transfer device using a transfer belt and forms an image, comprising: a drive unit which drives the transfer belt; a measuring section which measures a driving time of the drive unit; an accumulation section which accumulates the driving time measured by the measuring section; and a control section which effects a control to vary a driving speed of the drive unit each time the driving time accumulated in the accumulation section exceeds a predetermined time.

There is also provided an image forming method for an image forming apparatus which has a belt transfer device using a transfer belt and forms an image, comprising: measuring a driving time of a drive unit which drives the transfer belt; accumulating the measured driving time; and effecting a control to accelerate a driving speed of the drive unit by a predetermined amount, each time the accumulated driving time exceeds a predetermined time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
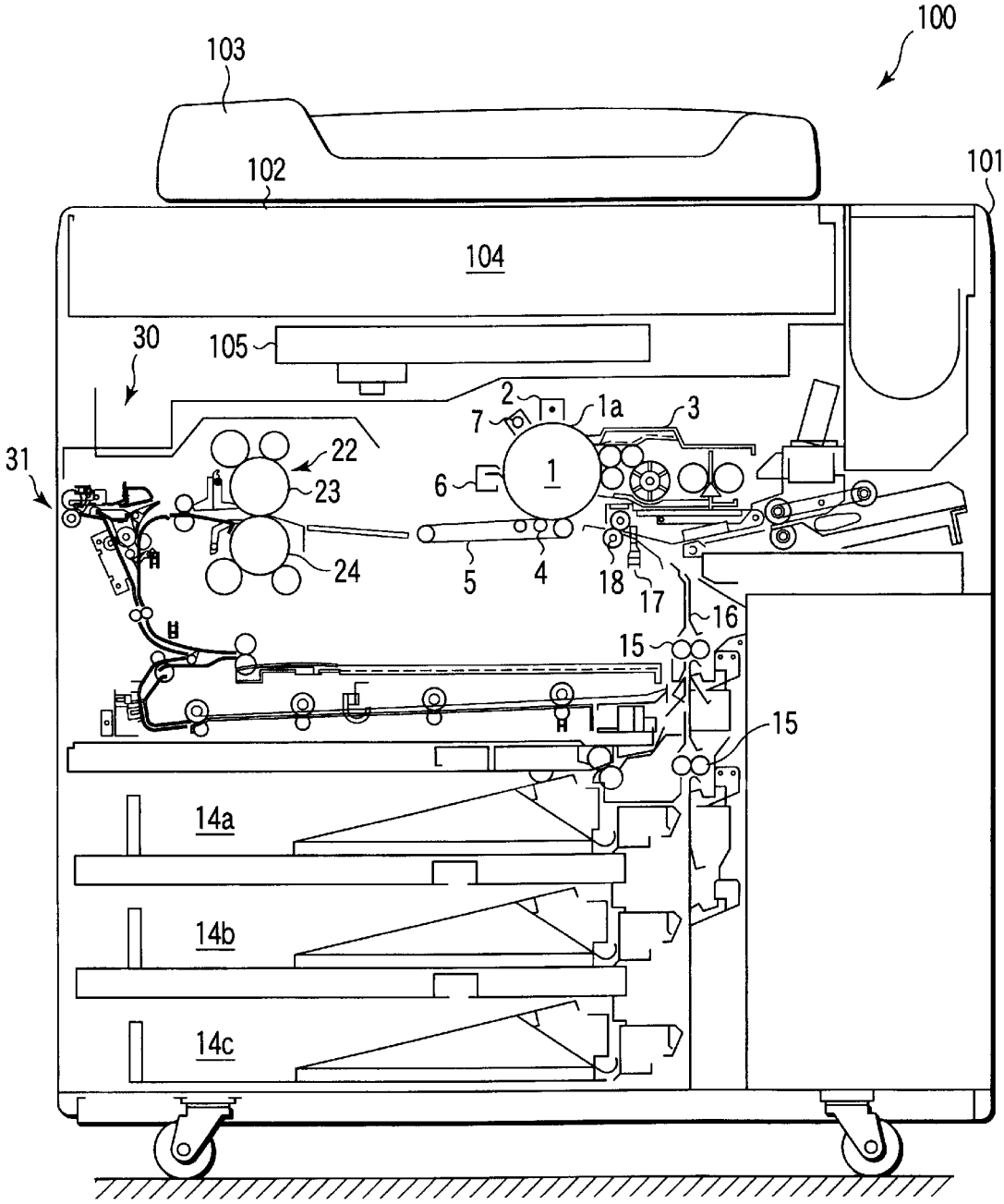
FIG. 1 is a cross-sectional view showing an internal structure of a digital multi-function peripheral according to an image forming apparatus of the present invention.

FIG. 1 is a cross-sectional view showing an internal structure of a digital multi-function peripheral (MFP) 100.

The digital MFP 100 has a casing 101 that is an outside frame of the apparatus. An original table glass 102 for placement of an original is provided on top of the casing 101. An automatic original document feeder (ADF) 103 is openably provided on the original table glass 102. The ADF 103 covers the original set on the original table glass 102 and automatically feeds the original to a predetermined position on the original table glass 102.

A scanner unit 104 is provided within the casing 101 below the original table glass 102. The scanner unit 104 illuminates the original set on the original table glass 102 and receives reflection light, thereby reading an image of the original. An exposing unit 105 is provided below the scanner unit 104. The exposing unit 105 radiates a laser beam, which is based on image data read by the scanner unit 104, onto a surface 1*a* of a photosensitive drum 1, and scans the drum surface 1*a* with the beam. Thus, an electrostatic latent image based on the image data is formed on the drum surface 1*a*. Detailed structures of the scanner unit 104 and exposing unit 105 do not relate to the subject matter of the present invention and are not shown in the drawing.

Around the photosensitive drum 1, other structural elements for executing a well-known electrophotographic process are provided. That is, a charger 2, a developing device 3, a transfer bias applying roller 4, a transfer belt 5, a cleaning device 6, and a charge erase lamp 7 are provided.

Sheet feed cassettes 14*a*, 14*b* and 14*c* containing paper sheets of different sizes and sorts are arranged in multiple stages below the photosensitive drum 1. Paper sheets taken out of the sheet feed cassettes 14*a*, 14*b* and 14*c* are fed toward the photosensitive drum 1 via a sheet convey path 16 equipped with pairs of sheet feed rollers 15.

The sheet fed toward the photosensitive drum 1 passes by an aligning switch 17 and is once aligned by aligning rollers 18. In synchronism with movement of a developer image on the drum surface 1*a*, the aligning rollers 18 are rotated and the aligned sheet is fed to a transfer region. At this time, a charge is applied by the transfer bias applying roller 4, and the developer image formed on the drum surface 1*a* is transferred onto the sheet. The speed at which the sheet is fed to the transfer region is set to be equal to a peripheral speed of the photosensitive drum 1, that is, a process speed at the time the electro-photographic process is executed.

The sheet, which has passed through the transfer region and on which the developer image has been transferred, is conveyed to a fixing device 22 via the transfer belt 5 with the process speed maintained. The fixing device 22 comprises a heat roller 23 provided above the convey path and a pressing roller 24 put in pressure contact with the heat roller 23 with the convey path interposed. The sheet, which has passed through a nip between the rollers 23 and 24 of the fixing device 22 and on which the developer image has been fixed, is discharged to the outside of the apparatus through a discharge port 31 formed in the casing 101 by means of a sheet discharge mechanism 30 (hereinafter referred to as "discharge mechanism 30").

Figure 2:
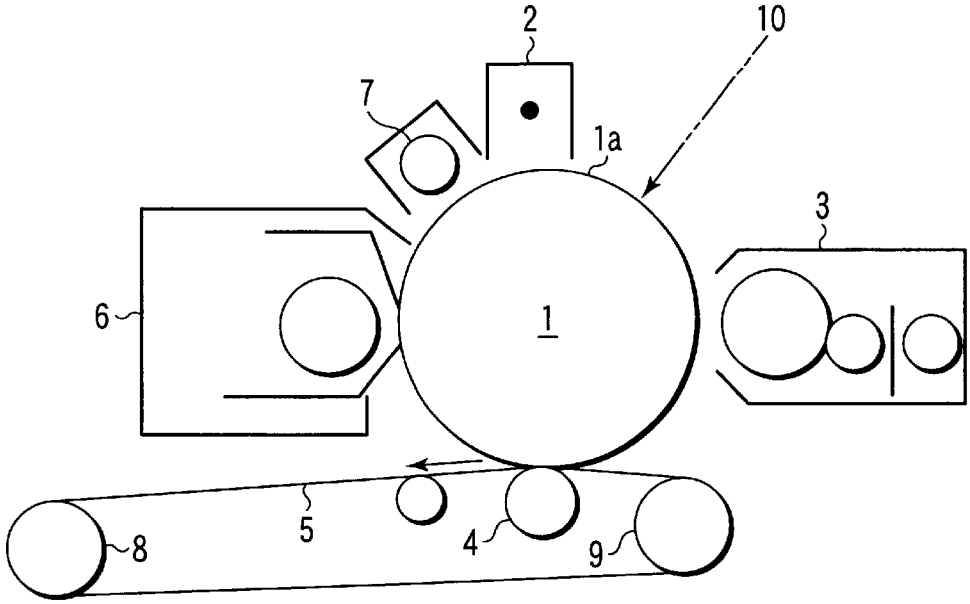
FIG. 2 shows the structures of a photosensitive drum and peripheral components thereof.

FIG. 2 shows the structures of the photosensitive drum 1 and peripheral components thereof.

The charger 2, developing device 3, transfer bias applying roller 4, transfer belt 5, cleaning device 6, and charge erase lamp 7 are provided around the photosensitive drum 1 that is a rotatable image carrying body. The transfer belt 5 is driven by a driving roller 8 and a driven roller 9.

The charger 2 uniformly charges the drum surface 1*a* of the photosensitive drum 1.

An electrostatic latent image is formed on the charged drum surface 1*a* by a laser beam 10 scanned by the exposing unit 105.

The developing device 3 supplies a developer agent to the electrostatic latent image formed on the photo-sensitive drum 1, and changes it into a visible image.

Subsequently, the visible image is transferred onto a transfer sheet (recording medium) carried on the transfer belt 5 by the function of the transfer bias applying roller 4. As mentioned above, the transfer sheet is conveyed to the fixing device 22 and the developer image is fixed.

The cleaning device 6 removes toner left on the photo-sensitive drum 1 after the transfer.

The charge erase lamp 7 erases the charge on the drum surface 1*a* of photosensitive drum 1.

Figure 3:
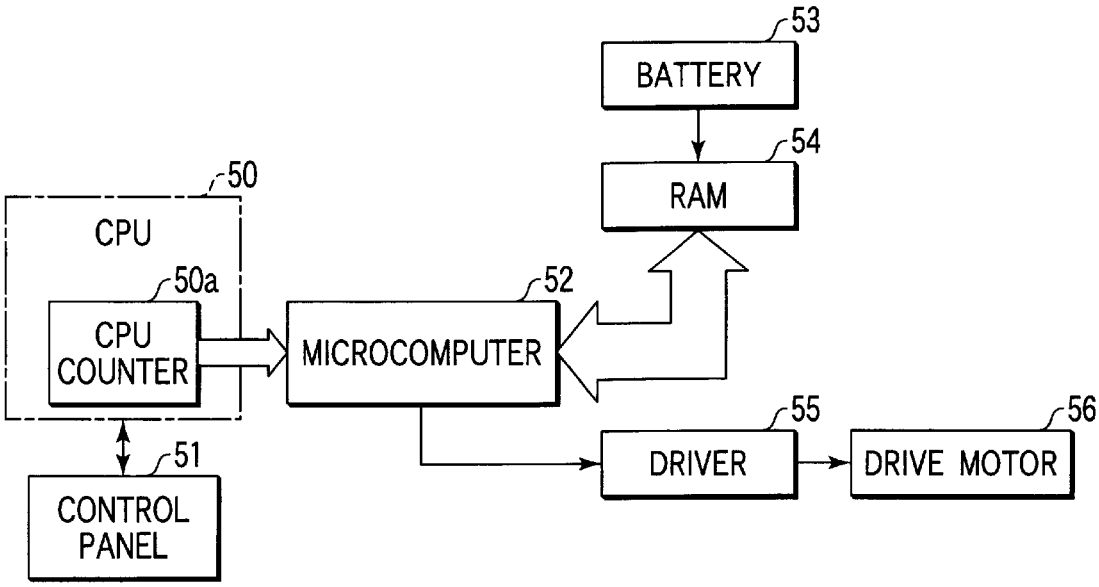
FIG. 3 is a block diagram showing the control structure for the main part of the digital multi-function peripheral and the transfer belt.

FIG. 3 shows the control structure for the main part of the digital multi-function peripheral and the transfer belt 5. Specifically, the control structure of the digital MFP comprises a CPU 50 that controls the entirety of the apparatus, a control panel 51 that controls various operations, and a microcomputer 52. The CPU 50 includes a CPU counter 50*a* as internal counter for feeding back a driving time of a drive motor 56.

The microcomputer 52 drives the drive motor 56 via a driver 55. The drive motor 56 drives the driving roller 8 of transfer belt 5. The microcomputer 52 processes the motor driving time calculated by the CPU counter 50*a*, and accumulates the processed result in a RAM 54. This serves as accumulated driving time data (count data) of the drive motor 56. The data accumulated in the RAM 54 is backed up by a battery 53 and always retained.

As will be described later in detail, the microcomputer 52 always accesses the accumulated driving time data (count data) accumulated in the RAM 54 and compares it with preset count data.

The transfer belt 5 will now be described.

Figure 4:
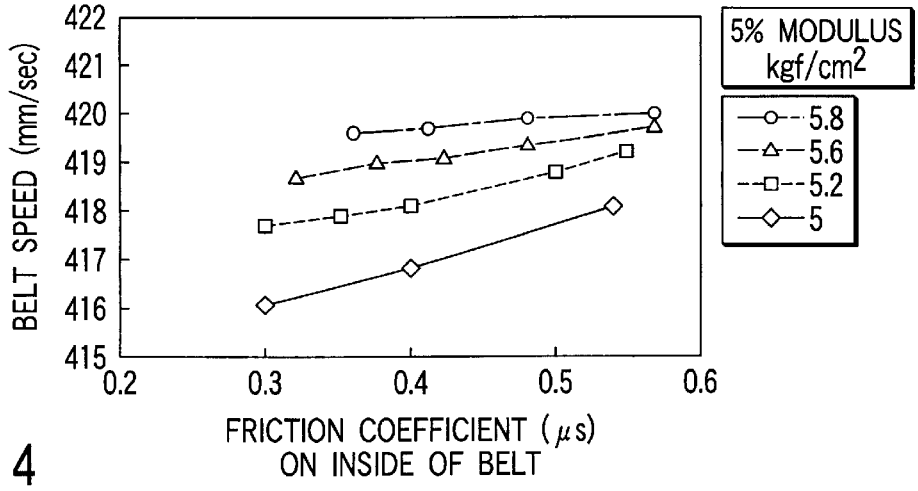
FIG. 4 shows factors in variation of a belt speed.

FIG. 4 shows factors in variation of the belt speed. In FIG. 4, the speed (mm/sec) of the belt lowers in a direction in which the friction coefficient ($\mu$s) on the inside of the belt decreases and in a direction in which the 5% modulus (force necessary to effect 5% extension: kgf/cm$^2$) of the belt decreases. The reason appears to be that a slip occurs at contact faces of the belt and the roller.

Figure 5:
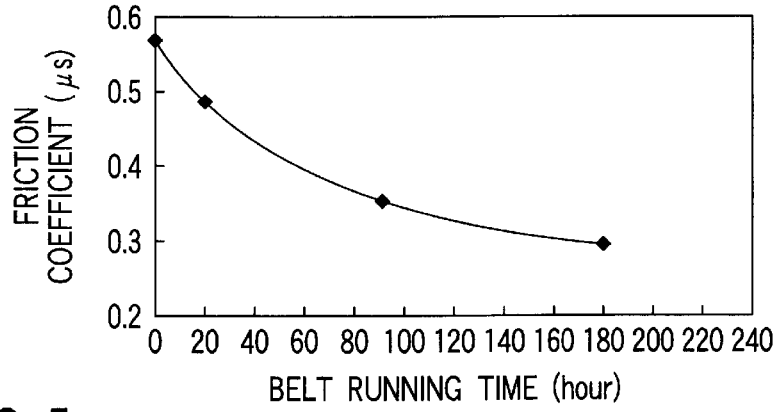
FIG. 5 shows a variation in friction coefficient on the inside of the belt with the passing of running time.

FIG. 5 shows a variation in friction coefficient on the inside of the belt with the passing of the running time. In FIG. 5, the friction coefficient on the inside of the belt decreases as the running time increases. This appears to lead to a decrease in the belt speed. For example, the friction coefficient is 0.48 $\mu$s at 20 hours, and the friction coefficient decreases to 0.3 $\mu$s at 180 hours.

Figure 6:
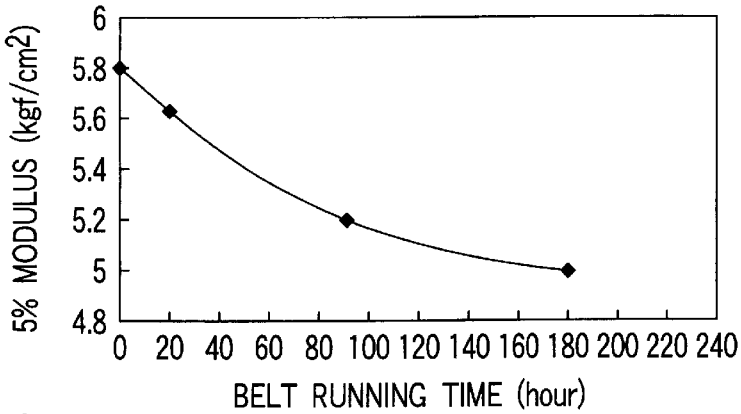
FIG. 6 shows a variation in 5% modulus of the belt with the passing of running time.

FIG. 6 shows a variation in 5% modulus (kgf/cm$^2$) of the belt with the passing of the running time. In FIG. 6, the 5% modulus decreases as the running time increases. This appears to lead to a decrease in the belt speed. For example, the 5% modulus is 5.6 at 20 hours, and the 5% modulus is 5 at 180 hours.

Figure 7:
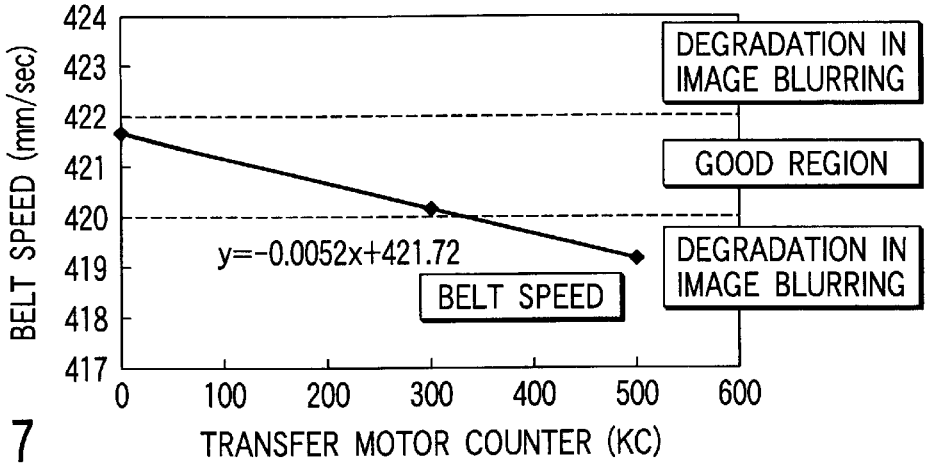
FIG. 7 shows a variation in belt speed.

FIG. 7 shows a variation in the belt speed. If the speed of the driving roller of the transfer belt is constant, the speed of the transfer belt decreases in accordance with an increase in the running time of the belt, as shown in the Figure. As a result, when the belt speed decreases to 420 mm/sec or less, the blurring in image is aggravated. Specifically, when the difference between the speed of the transfer belt 5 and the rotational speed of the photosensitive drum 1 becomes about 2.0 mm/sec or more, the image blur becomes conspicuous.

Figure 8:
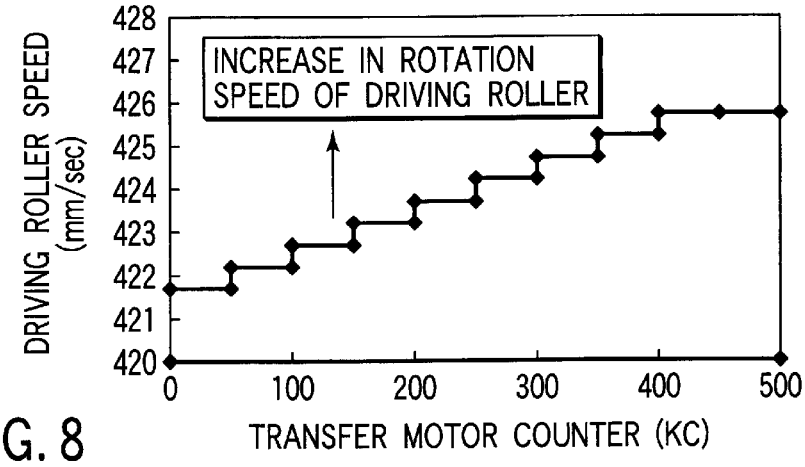
FIG. 8 is a view for explaining a control for the number of revolutions of a driving roller.
Figure 9:
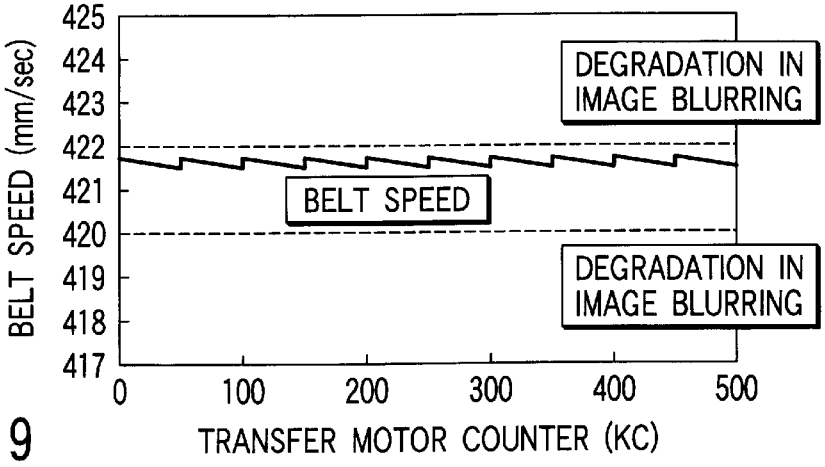
FIG. 9 is a view for explaining a control for keeping the speed of the transfer belt within a fixed range.

In the present invention, as shown in FIG. 8, an open-loop control is performed. In the open-loop control, the number of revolutions of the driving roller is increased in accordance with the belt running time. Thereby, as shown in FIG. 9, the speed of the transfer belt can be maintained within a predetermined range from the initial stage to the end of the design life. As a result, the difference between the speed of the transfer belt 5 and the rotational speed of the photosensitive drum 1 does not become 2.0 mm/sec or more, and the aggravation in image blur can be suppressed.

Figure 10:
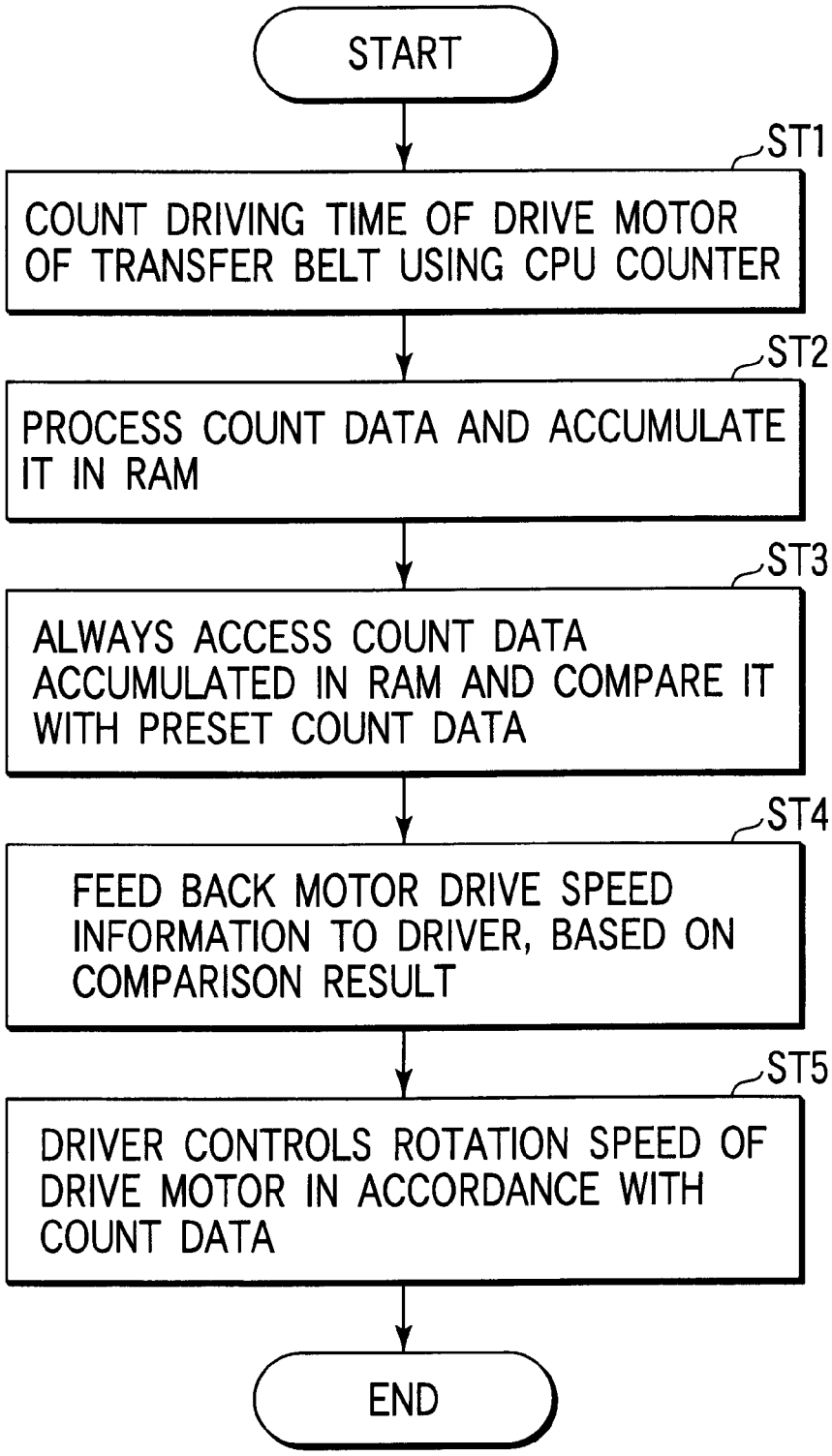
FIG. 10 is a flow chart illustrating a speed control for the transfer belt.

With the structure as described above, the speed control for the transfer belt 5 will now be described with reference to a flow chart of FIG. 10.

To start with, the CPU 50 counts the driving time of drive motor 56 of transfer belt 5, using the CPU counter 50*a* (ST1). The CPU counter 50*a* counts up one count for a rotation time of 2.0 seconds of the drive motor 56. The one count substantially corresponds to one copy.

The microcomputer 52 processes count data counted by the CPU counter 50*a*, and accumulates the processed result in the RAM 54 (ST2).

The microcomputer 52 always accesses the accumulated count data in the RAM 54 and compares it with preset count data (ST3).

Based on the comparison result, the microcomputer 52 feeds back motor drive speed information to the driver 55 (ST4), and the driver 55 controls the rotation speed of drive motor 56 in accordance with the driving time (count data) (ST5).

Figures 11, 12:
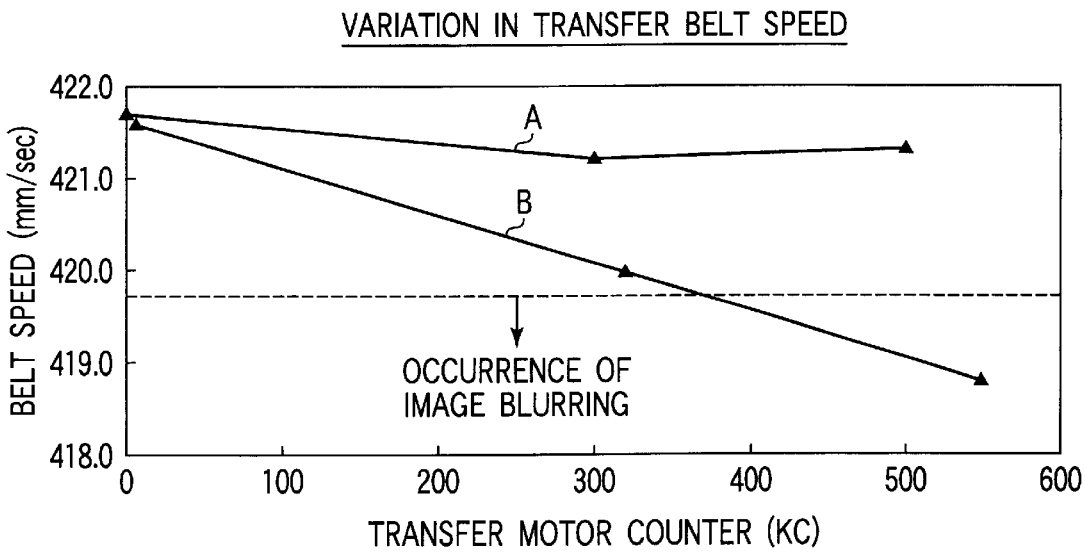
FIG. 11 shows examples of preset count data.
FIG. 12 is a graph showing a variation in transfer speed with the passing of time.

FIG. 11 shows examples of preset count data in the microcomputer 52.

As shown in FIG. 11, the microcomputer 52 initially sets the speed of driving roller 8 of transfer belt 5 at 421.7 mm/sec, and the transfer belt 5 is also driven at 421.7 mm/sec. As has been described above, the rotation of the drive motor 56 for driving the drive motor 8 is controlled by the driver 55.

When the count data exceeds "50000", the microcomputer 52 sets an increment value of speed control (coefficient) at "1" and effects acceleration by 0.5 mm/sec. Accordingly, the speed of driving roller 8 is set at 422.2 mm/sec. In this case, the speed of transfer belt 5 is estimated at 421.8 mm/sec.

When the count data exceeds "100000", the microcomputer 52 sets an increment value of speed control (coefficient) at "2" and effects acceleration by 0.5 mm/sec. Accordingly, the speed of driving roller 8 is set at 422.7 mm/sec. In this case, the speed of transfer belt 5 is estimated at 421.8 mm/sec.

In this manner, the speed of driving roller 8 is controlled when the count data exceeds "150000", "200000", "250000", . . . , "500000". The count data "500000" represents the design life of transfer belt 5.

In this embodiment, acceleration is effected in units of 0.5 mm/sec for every count of "50000".

FIG. 11 also shows actual measured values in a case where the present invention is not applied. The speed of driving roller 8 for driving transfer belt 5 is initially set at 421.7 mm/sec, and the transfer belt 5 is also driven at 421.7 mm/sec.

When the count data exceeds "300000", the speed of driving roller 8 is controlled at 421.7 mm/sec, and the transfer belt 5 is driven at 420.2 mm/sec.

Even when the count data exceeds "500000", the speed of driving roller 8 is controlled at 421.7 mm/sec, and the transfer belt 5 is driven at 419.1 mm/sec.

FIG. 12 shows a variation in transfer belt speed with the passing of time in the cases where the speed control for the transfer belt 5 has been effected and not effected.

Line segment A indicates the case where the above-described speed control for transfer belt 5 has been effected, and degradation in image blurring can be suppressed.

Line segment B indicates the case where the speed control for the transfer belt has not been effected, and image blurring deteriorates when the count data exceeds "370000".

In a case where the transfer belt 5 is to be replaced due to some accident before the end of the design life, a serviceman who replaces it with a new one resets and clears the increment value of speed control (coefficient) of drive motor 56 of transfer belt 5 through the control panel 51.

As has been described above, in this embodiment of the invention, a decrease in transfer belt speed is controlled and corrected in accordance with the driving time of the transfer belt, thereby suppressing, with low cost, blurring of images, image magnification variation, etc. due to the decrease in transfer belt speed, without the need to provide sensors for sensing and controlling the variation in speed of a transfer belt.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus which has a belt transfer device using a transfer belt and forms an image, comprising:

a drive unit which drives the transfer belt;

a measuring section which measures a driving time of the drive unit;

an accumulation section which accumulates the driving time measured by the measuring section; and a control section which effects a control to vary a driving speed of the drive unit each time the driving time accumulated in the accumulation section exceeds a predetermined time, wherein the control section effects a control to accelerate the driving speed of the drive unit by a predetermined amount, each time the driving time accumulated in the accumulation section exceeds the predetermined time.

2. An image forming apparatus which has a belt transfer device using a transfer belt and forms an image, comprising:

a drive unit which drives the transfer belt;

a measuring section which measures a driving time of the drive unit;

an accumulation section which accumulates the driving time measured by the measuring section; and a control section which effects a control to vary a driving speed of the drive unit each time the driving time accumulated in the accumulation section exceeds a predetermined time, wherein the control section effects a control to accelerate the driving speed of the drive unit that drives a driving roller for driving the transfer belt so as to accelerate the speed of the driving roller by a predetermined amount, each time a count value accumulated in the accumulation section exceeds the predetermined amount.

3. An image forming apparatus which has a belt transfer device using a transfer belt and forms an image, comprising:

a drive unit which drives the transfer belt;

a measuring section which measures a driving time of the drive unit;

an accumulation section which accumulates the driving time measured by the measuring section; and a control section which effects a control to vary a driving speed of the drive unit each time the driving time accumulated in the accumulation section exceeds a predetermined time, wherein the control section effects a control to restore the driving time accumulated in the accumulation section to zero, when the transfer belt has been replaced.

4. An image forming method for an image forming apparatus which has a belt transfer device using a transfer belt and forms an image, comprising:

measuring a driving time of a drive unit which drives the transfer belt;

accumulating the measured driving time; and effecting a control to accelerate a driving speed of the drive unit by a predetermined amount, each time the accumulated driving time exceeds a predetermined time.

* * * * *